US005758622A

United States Patent [19]

Rembold et al.

[11] Patent Number: 5,758,622

[45] Date of Patent: Jun. 2, 1998

[54] PROCESS AND DEVICE FOR CONTROLLING AN INTERNAL COMBUSTION ENGINE

[75] Inventors: Helmut Rembold; Gerhard Wiltschek, both of Stuttgart; Uwe Mueller, Korntal-Muenchingen, all of Germany

[73] Assignee: Robert Bosch GmbH, Stuttgart, Germany

[21] Appl. No.: 802,318

[22] Filed: Feb. 18, 1997

[30] Foreign Application Priority Data

Feb. 24, 1996 [DE] Germany ..... 196 07 070.8

[51] Int. Cl.[6] ..... F02M 37/04

[52] U.S. Cl. ..... 123/456; 123/179.17; 123/516

[58] Field of Search ..... 123/456, 179.17, 123/458, 447, 516, 467

[56] References Cited

U.S. PATENT DOCUMENTS

| | | | |
|---|---|---|---|
| 5,327,872 | 7/1994 | Morikawa | 123/516 |
| 5,394,844 | 3/1995 | Akimoto | 123/179.17 |
| 5,425,342 | 6/1995 | Ariga | 123/179.17 |
| 5,456,233 | 10/1995 | Felhofer | 123/456 |
| 5,598,817 | 2/1997 | Igarashi | 123/456 |
| 5,626,121 | 5/1997 | Kushida | 123/456 |

FOREIGN PATENT DOCUMENTS

| | | | |
|---|---|---|---|
| 195 39 885 | 11/1996 | Germany . | |
| 0200663 | 12/1982 | Japan | 123/516 |

*Primary Examiner*—Carl S. Miller
*Attorney, Agent, or Firm*—Kenyon & Kenyon

[57] ABSTRACT

In a process and device for controlling an internal combustion engine, a fuel pump delivers fuel from a low-pressure area to a high-pressure area. The fuel can be delivered by activating injectors of the combustion chambers of the internal combustion engine. The pressure of the fuel in the high-pressure area is regulated to a predefinable value using a regulating means. The regulating means is activated immediately prior to and/or during the time when the injectors are activated to increase the pressure.

15 Claims, 5 Drawing Sheets

PROCESS AND DEVICE FOR CONTROLLING AN INTERNAL COMBUSTION ENGINE

BACKGROUND INFORMATION

German Patent No. 19.539.885 (not a prior publication) describes a process and device for controlling an internal combustion engine, in which at least one fuel pump delivers the fuel from a low-pressure area to a high-pressure area. The fuel pressure in the high-pressure area is regulatable to a predefinable value. The fuel can be delivered to the individual combustion chambers of the internal combustion engine by activating injectors. Such systems, where fuel is delivered to the combustion chambers at a high pressure using injectors, are usually referred to as "common rail systems."

When the fuel delivery injectors are activated, the pressure in the high-pressure area drops below the setpoint for a short period of time. Accurate fuel delivery is, however, only possible at constant pressure. The pressure must therefore have a value in the high-pressure area that is as constant as possible.

SUMMARY OF THE INVENTION

The pressure can be kept at a constant value with the process and device according to the present invention.

DETAILED DESCRIPTION

Figure 1:
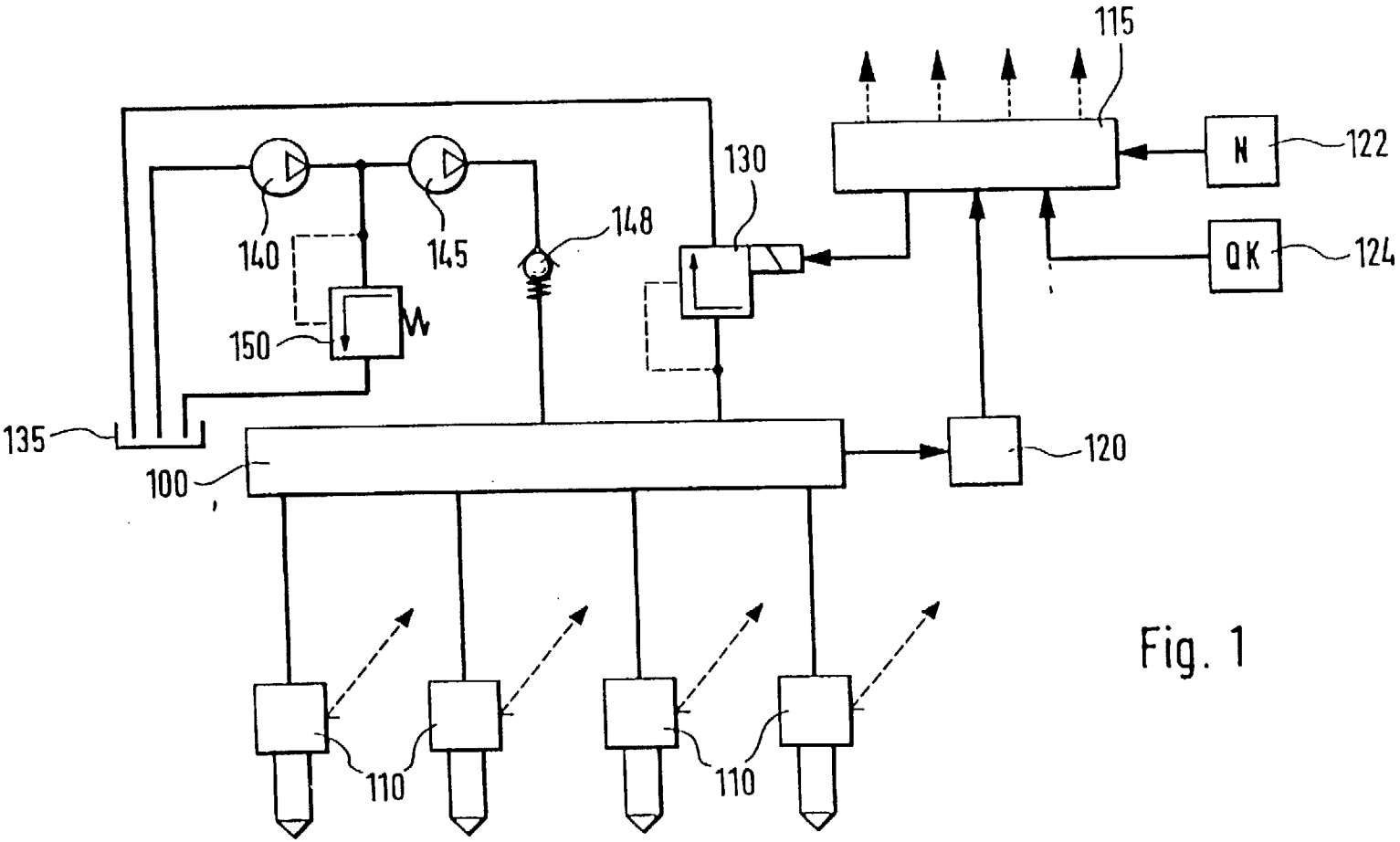
FIG. 1 shows a block diagram of a common rail system.

FIG. 1 shows a block diagram of a common rail system. Such a rail is denoted with 100. Rail 100 serves as a storage device for the fuel under pressure and is connected to injectors 110, which deliver the fuel to the combustion chamber of the internal combustion engine (not illustrated). The injectors can receive control signals from a controller 115. The controller processes signals of a pressure sensor 120, a speed sensor 122, and a fuel amount selector 124, as well as other sensors that monitor the operating status of the internal combustion engine.

Furthermore, pressure regulating valve 130 receives a control signal from controller 115. Pressure regulating valve 130 is connected between rail 100 and a fuel tank 135. Pressure regulating valve 130 is preferably configured so that at a given pressure P in rail 100 the connection to fuel tank 135 is opened. The pressure at which the connection opens can be set by varying the intensity of the control signal.

Fuel tank 135 is also connected to rail 100 through a pre-pump 140 and a high-pressure pump 145. A check valve 148 can be located between high-pressure pump 145 and rail 100. A limiting valve 150, capable of opening the connection to fuel tank 135, can be arranged between pre-pump 140 and high-pressure pump 145.

The area between high-pressure pump 145 and the injectors is referred to as the high-pressure area. The area between the tank and the high-pressure pump is referred to as the low-pressure area.

This device operates as follows:

Pre-pump 140 delivers the fuel from tank 135 to high-pressure pump 145. High-pressure pump 145 compresses the fuel to a relatively high pressure. Normally, pressures between 30 bar and 100 bar are produced in externally ignited internal combustion engine systems, while pressures between 1000 bar and 2000 bar are used in self-igniting internal combustion engines. The fuel goes from high-pressure pump 145 into rail 100 via check valve 148. The fuel is at a high pressure in rail 100.

Depending on the control signal of controller 115, injectors 110 open or close the connection between the rail and the individual combustion chambers. Thus, controller 115 controls the injection start, the injection end, and therefore also the amount of the fuel injected into the individual combustion chamber.

If an excessively high pressure builds up between the pre-pump and the high-pressure pump, limiting valve 150 opens the connection to the tank.

The pressure in the high-pressure area, in particular in rail 100, is monitored with a pressure sensor 120. Depending on this pressure P, the controller computes the control signals for injectors 110. Furthermore, this signal is used for pressure regulation, i.e., the pressure P in the rail can be set at a predefinable value by opening and closing pressure regulating valve 130.

The injectors are activated depending on the speed, the desired fuel amount QK, and pressure P in the high-pressure area.

At low speeds and/or large amounts of fuel, common rail systems with a speed coupling between high-pressure pump 145 and internal combustion engine present the problem of an undesirable drop in the rail pressure during injection. In such systems, high-pressure pump 145 is coupled with the internal combustion engine and is driven by the internal combustion engine directly or through a speed reduction gear of the internal combustion engine. This occurs due to the low delivery rates of the high-pressure pump in this range and the delayed closing of pressure regulating valve 130 required for setting the pressure. In principle, the drop in pressure can be limited by making the rail volume larger. This, however, results in a deterioration of the pressure dynamics in the rail, especially during pressure build-up at start.

Figure 2:
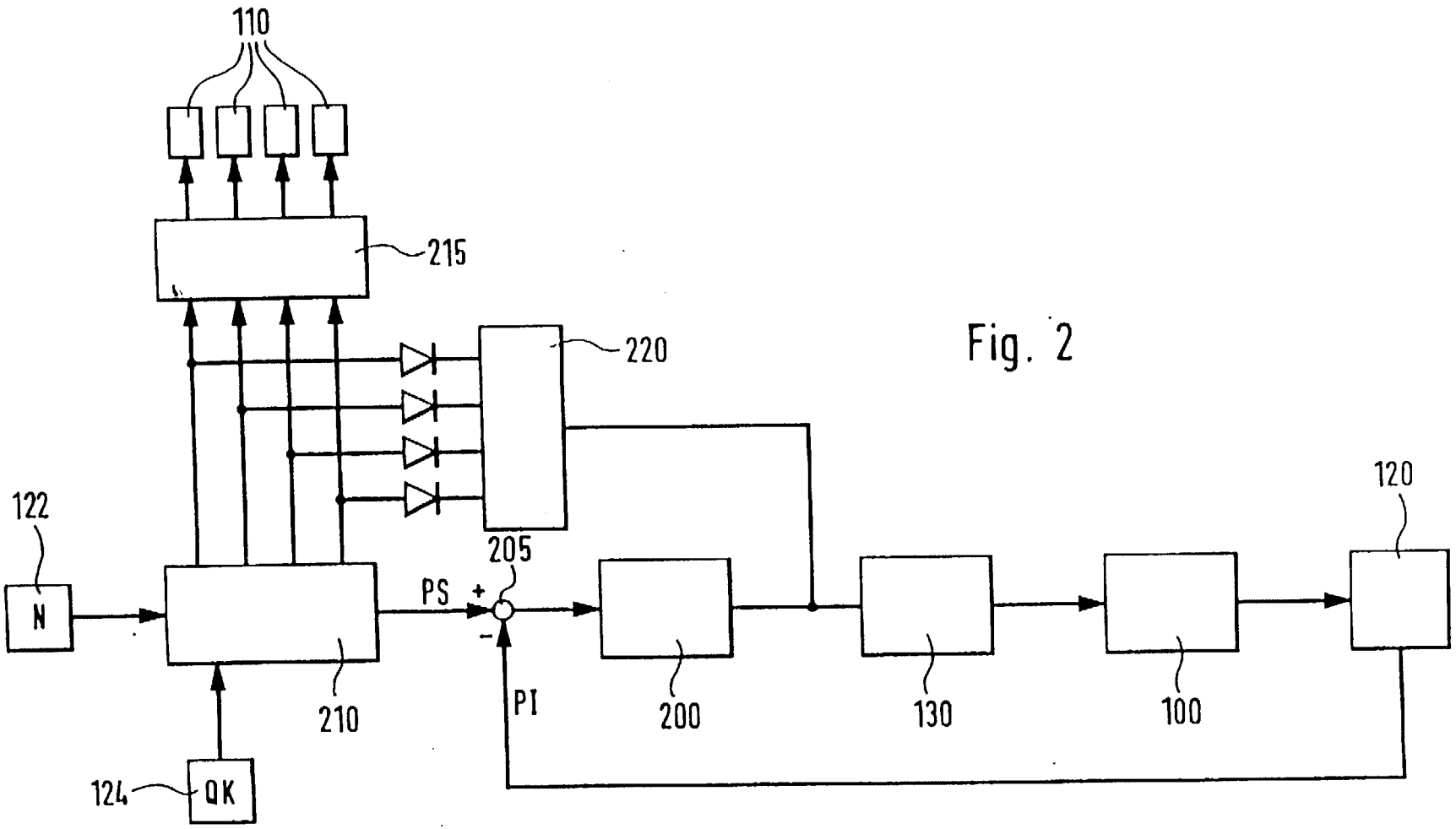
FIG. 2 shows a pressure regulation.

FIG. 2 shows the pressure regulation in more detail. Components already described in FIG. 1 are denoted with the same numbers.

A pressure regulating valve 130 receives a control signal from regulator 200. Pressure regulator 200 processes the output signal of a node 205. Node 205 receives the output signal PI of pressure sensor 120 with a negative sign and the output signal PS of a control device 210 with a positive sign.

Control device 210 processes signal N of speed sensor 122 and the signal QK of fuel amount selector 124. The output stages 215, which prepare the control signals for injectors 110, receive signals from control device 210. The control signals for output stages 215 are also supplied to an output stage 220, which supplies a signal to pressure regulating valve 130.

This device operates as follows: Based on the comparison between setpoint PS predefined by control device 210 and the actual value PI, provided by pressure sensor 120, controller 200 computes a control signal to be supplied to pressure regulating valve 130. Depending on this signal, the pressure regulating valve assumes a certain position. Depending on the position of the pressure regulating valve, a pressure is set in rail 100, which is sensed by pressure sensor 120 and sent back to node 205.

Furthermore, output stages 215 receive control signals from control device 210; these control signals are supplied to injectors 110 and output stage 220, which supplies control signals to pressure regulating valve 130.

This means that at the same moment that one of injectors 110 receives an injection control signal, pressure regulating valve 130 receives a control signal to increase the pressure.

Figure 3A:
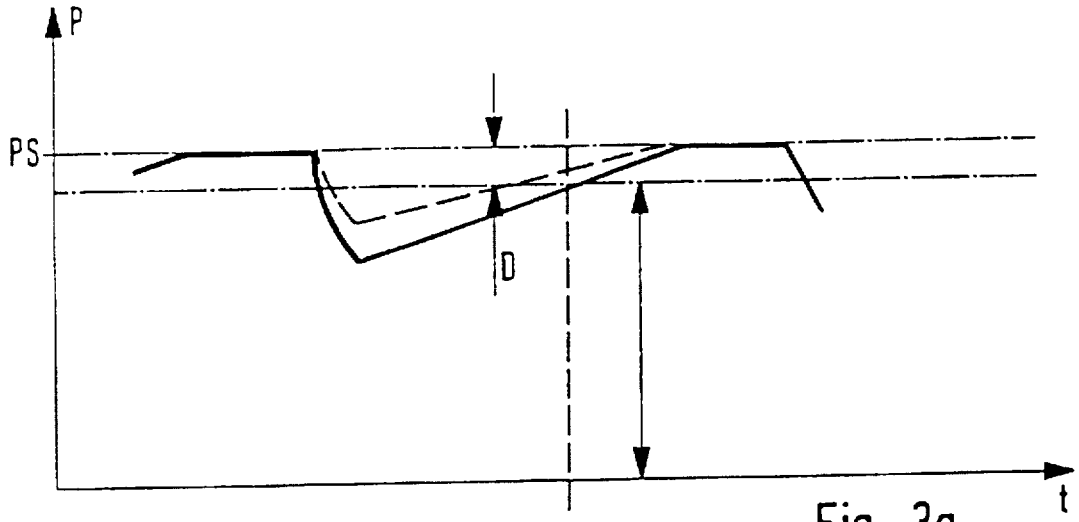
FIG. 3*a* shows a first signal plotted against time t.
Figure 3B:
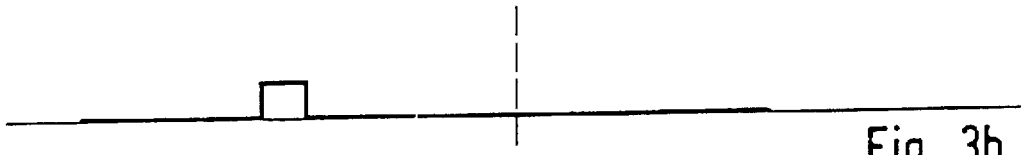
FIG. 3*b* shows a second signal plotted against time t.
Figure 3C:
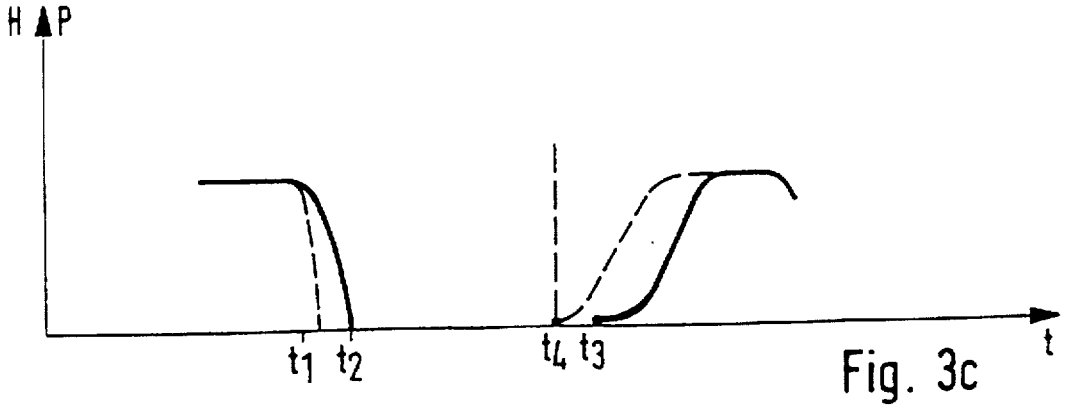
FIG. 3*c* shows a third signal plotted against time t.

FIGS. 3*a*, 3*b*, and 3*c* show various signals plotted against time t. FIG. 3*a* shows pressure P. FIG. 3*b* shows the control signal for an injector, and FIG. 3*c* shows the stroke H of the pressure regulating valve. In normal control, these signals vary according to the curves drawn with the solid lines.

FIG. 3*a* shows the setpoint PS for pressure P with a broken line. A line parallel thereto indicates the control range. This control range is marked with two vertical arrows. As soon as the pressure exceeds setpoint PS, pressure regulating valve 130 opens and the pressure drops. As soon as the pressure drops below the control range, the pressure regulating valve receives a signal to close allowing the pressure to build up.

Pressure is regulated until time t1 and the pressure normally remains at its setpoint PS. In the control mode, the pressure regulating valve is controlled by pressure regulator 200 so that it assumes a position resulting in the pressure assuming its setpoint value PS.

If the injector is activated at time t1, which is represented in FIG. 3*b* by a corresponding signal, the pressure drops due to the injection. Similarly, an increase in the deviation from the setpoint activates pressure regulator 200 and controls pressure regulating valve 130 in the closing direction. As soon as the pressure drops below the control range, pressure regulator 200 emits a signal, which results in the pressure regulating valve closing completely. This results in the valve needle moving in the direction of the closed position after a short delay. A certain amount of time is required for the valve needle to close due to its inertia and the inductance of the coil. During this time the pressure drops further.

At time t2, when pressure regulating valve 130 is completely closed or the injection is completed, the pressure rises again. As soon as the pressure reaches the control range at time t3, pressure regulator 200 becomes active and sets the valve needle so that the pressure remains at its setpoint PS.

In order to reduce the drop in pressure, it is proposed that pressure regulating valve 130 be activated at time t1 simultaneously with the injectors so that it directly assumes a position resulting in pressure build-up. This means that pressure regulating valve 130 receives the maximum available power. In this case, the pressure and stroke of valve needle H will vary as shown by the dashed curve.

The pressure drops less abruptly and the valve needle reaches its new position considerably faster. When pressure builds up, the pressure control range is reached at an earlier point in time t4. The amount of fuel flowing to the tank is now much smaller, which results in a smaller drop in pressure. The pressure setpoint is reached again considerably faster.

The procedure according to the present invention can be accomplished similarly by activating the injectors and pressure regulating valve 130 simultaneously. It is particularly advantageous if the invention is implemented in digital form. One configuration of such a digital embodiment is shown in FIGS. 4*a* and 4*b*.

Figure 4A:
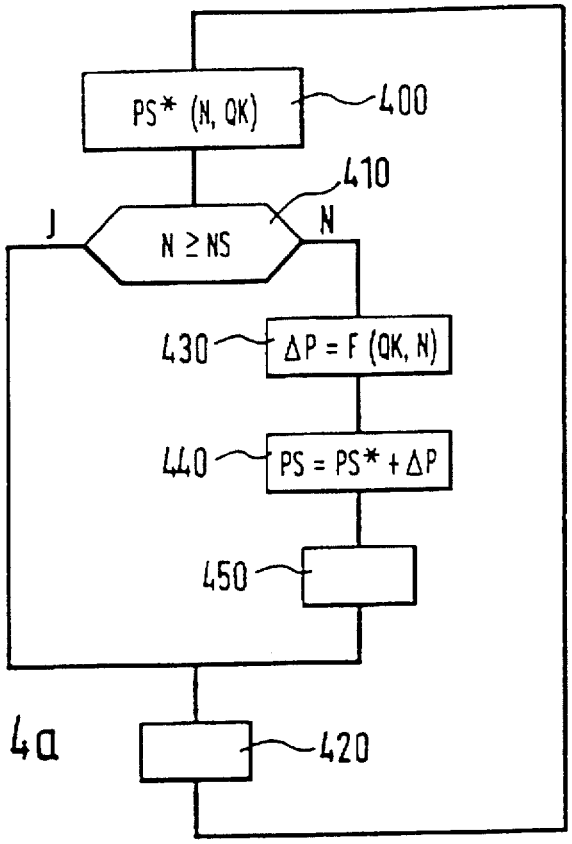
FIG. 4*a* shows a flow chart illustrating a first embodiment of the process according to the present invention.
Figure 4B:
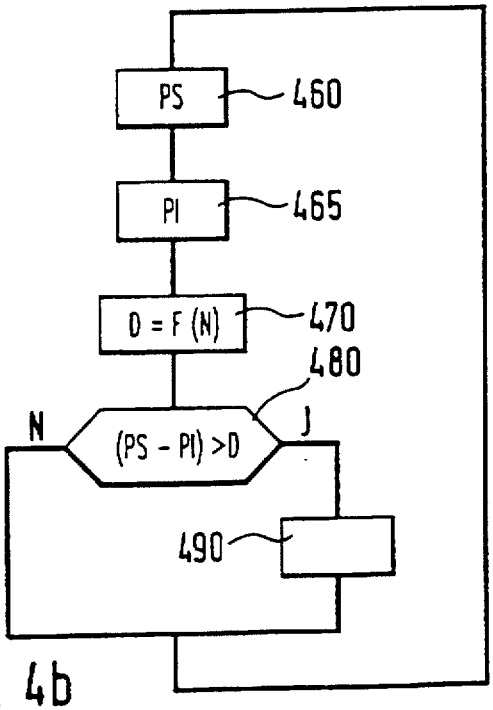
FIG. 4*b* shows a flow chart illustrating a second embodiment of the process according to the present invention.

FIG. 4*a* shows a program for activating pressure regulating valve 130. In a first step 400, a setpoint PS* is output based on the different operating parameters such as, for example, rotation speed N and the amount of fuel QK to be injected. The signal of a sensor using the speed of the internal combustion engine and/or of the injection system is used as the speed signal. The speed of the injection system corresponds to the speed at which the high-speed pump is driven. The pressure setpoint value PS* is preferably stored in a table as a function of this parameter and any other parameters.

Query 410 that follows checks if the speed is greater than or equal to a setpoint value NS. If so, injectors 110 are activated in step 420. If query 410 finds that the speed is less than the setpoint, a value ΔP that is a function of speed N and the amount of fuel QK to be injected is generated in step 430. In the subsequent step 440 the setpoint PS for pressure regulator 130 is determined as the sum of values PS* and ΔP. Subsequently, pressure regulating valve 130 is activated in step 450. Then, in step 420, injectors 110 are activated.

In a preferred embodiment, the pressure regulating valve is activated at time $t_0$. Time $t_0$ precedes time $t_1$, when injectors 110 are activated, by a predeterminable delay. This delay is selected so that the pressure regulating valve is in its closed position allowing the pressure to build up when injection starts.

If the pressure regulating valve is activated at the same time as the injectors, a faster pressure build-up can be achieved, since otherwise no activation takes place until the pressure has dropped. If the pressure regulating valve is activated with a certain delay before the injectors, pressure can build up even at the beginning of the injection. This means that the pressure drops very little or not at all.

Steps 430 and 440 can be omitted in one embodiment of the invention. In this simplified configuration pressure regulating valve 130 is activated simultaneously with injectors 110 or before the injectors with a suitable delay.

Pressure regulating valve 130 is activated only when the speed is less than a setpoint NS. At higher speeds early activation of pressure regulating valve 130 is not necessary, since at increasing speeds the drop in pressure is less due to the higher pump delivery rate. Experience shows that from a certain speed NS on, the switching mode operation of pressure regulating valve 130 can be omitted, since it places a higher stress on the valve, which in turn requires the use of more expensive materials.

In steps 430 and 440, the pressure setpoint is increased by ΔP over the actual setpoint PS* to compensate for the drop in pressure at low speeds, and this value is increased by an amount so that the average pressure will approximately correspond to setpoint pressure PS*. It is particularly advantageous if the pressure is increased by an amount ΔP that depends on the injected amount QK and the speed. ΔP is selected so that it corresponds to one-half of the drop in pressure during injection.

Figure 5:
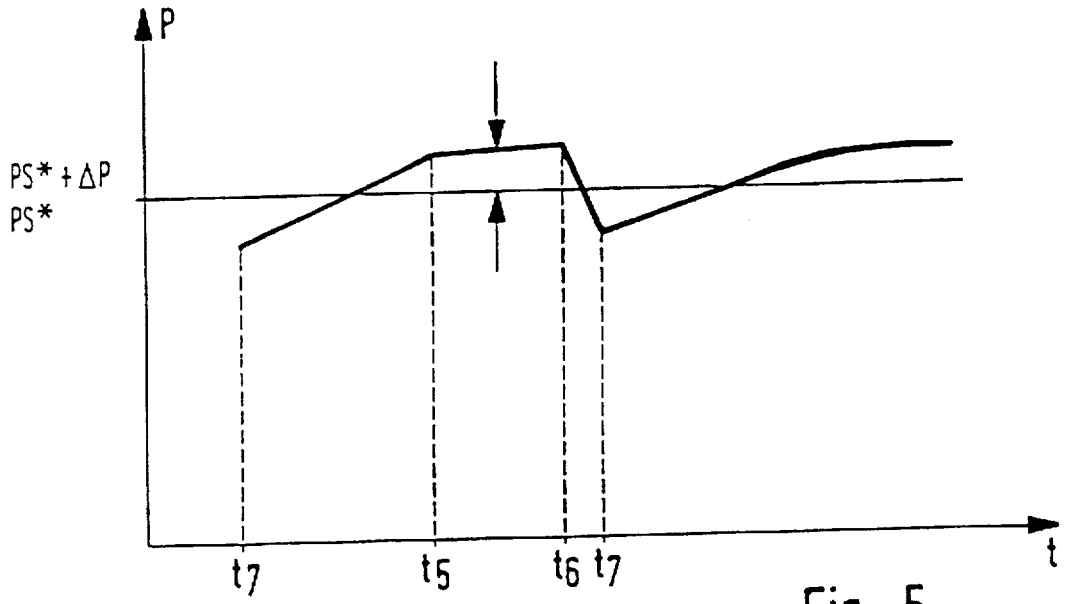
FIG. 5 shows pressure plotted against time t.

FIG. 5 shows the variation of pressure P when the setpoint value is increased by ΔP. PS* denotes the desired pressure. At time t5 the pressure is set to that value. At time t6 injection starts and the pressure drops. Injection is completed at time t7. Then pressure builds up again to PS*+ΔP.

FIG. 4*b* shows another embodiment of the present invention. In a first step 460, setpoint value PS is defined. In a second step 465, the actual value PI is measured. In the subsequent step 470, a value D is defined as a function F of at least the speed N. Query 480 that follows checks whether the difference PS less PI is greater than D. If not, step 460 is repeated. If the actual pressure PI differs from setpoint PS by more than a difference D, switching mode operation is started in step 490. This means that pressure regulating valve 130 is activated so that it closes, allowing pressure to build up. The threshold for changing from switching to control mode and vice versa is defined flexibly as a function of speed.

What is claimed is:

1. A process for controlling an internal combustion engine, comprising the steps of:

(a) delivering fuel from a low-pressure area to a high-pressure area using a fuel pump;

(b) activating injectors to deliver the fuel to combustion chambers of the engine;

© regulating a pressure of the fuel in the high-pressure area to a predetermined value using a regulating device;

(d) activating the regulating device to increase a pressure immediately prior to or during a time when the injectors are activated;

(e) switching the regulating device from a regulating mode to a switching mode depending on at least one of a speed of the engine and an amount of injected fuel, wherein the switch to the switching mode occurs when the pressure deviates from a second predetermined value by a third predetermined value; and (f) increasing the second predetermined value by a fourth predetermined value prior to the injection.

2. The process according to claim 1, wherein the third and fourth predetermined values are predetermined as a function of at least one of the engine speed and the amount of injected fuel.

3. The process according to claim 1, wherein the fourth predetermined value is set to one-half of a drop in pressure during injection.

4. A process for controlling an internal combustion engine, comprising the steps of:

(a) delivering fuel from a low-pressure area to a high-pressure area using a fuel pump;

(b) activating injectors to deliver the fuel to combustion chambers of the engine;

© regulating a pressure of the fuel in the high-pressure area to a predetermined value using a regulating device; and (d) simultaneously with step (b), activating the regulating device to increase a pressure.

5. The process according to claim 1, wherein step (c)includes the step of regulating the pressure to values in a range between 30 bar and 100 bar.

6. The process according to claim 1, wherein step (c) includes the step of regulating the pressure to values in a range between 1000 bar and 2000 bar.

7. The process according to claim 1, further comprising the step of switching the regulating device from a regulating mode to a switching mode depending on at least one of a speed of the engine and an amount of injected fuel.

8. The process according to claim 7, wherein the switch to the switching mode occurs when the pressure deviates from a second predetermined value by a third predetermined value.

9. A device for controlling an internal combustion engine, comprising:

at least one fuel pump for delivering fuel from a low-pressure area to a high-pressure area;

means for activating injectors for delivering fuel to combustion chambers of the engine;

means for regulating a pressure of the fuel in the high-pressure area to a predetermined value; and means for actuating the means for regulating to increase the pressure simultaneously to a time when the injectors are activated.

10. A process for controlling an internal combustion engine, comprising the steps of:

(a) delivering fuel from a low-pressure area to a high-pressure area using a fuel pump;

(b) activating at least one injector to deliver the fuel to combustion chambers of the engine at a first time;

© regulating a pressure of the fuel in the high-pressure area to a predetermined value using a regulating device;

(d) activating the regulating device to increase a pressure at a selected second time prior to the first time, the selected second time being selected as a function of the first time.

11. The process according to claim 10, wherein step (c)includes the step of regulating the pressure to values in a range between 30 bar and 100 bar.

12. The process according to claim 10, wherein step © includes the step of regulating the pressure to values in a range between 1000 bar and 2000 bar.

13. The process according to claim 10, further comprising the step of switching the regulating device from a regulating mode to a switching mode depending on at least one of a speed of the engine and an amount of injected fuel.

14. The process according to claim 13, wherein the switch to the switching mode occurs when the pressure deviates from a second predetermined value by a third predetermined value.

15. A device for controlling an internal combustion engine, comprising:

at least one fuel pump for delivering fuel from a low-pressure area to a high-pressure area;

means for activating at least one injector for delivering fuel to at least one combustion chamber of the engine at a first time;

means for regulating a pressure of the fuel in the high-pressure area to a predetermined value; and means for actuating the means for regulating to increase the pressure at a selected second time prior to the first time, the selected second time being selected as a function to the first time.

* * * * *